US008410032B1

(12) United States Patent
Carroll et al.

(10) Patent No.: US 8,410,032 B1
(45) Date of Patent: Apr. 2, 2013

(54) MULTI-VEHICLE AUTOMATIC TRANSMISSION FLUID

(75) Inventors: Joseph B. Carroll, Glen Allen, VA (US); Christopher S. Cleveland, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 13/543,996

(22) Filed: Jul. 9, 2012

(51) Int. Cl.
*C10M 141/08* (2006.01)
*C10M 141/06* (2006.01)

(52) U.S. Cl. ..... 508/273; 508/274; 508/287; 508/291; 508/293; 252/78.1

(58) Field of Classification Search ..... 508/273, 508/274, 287, 291, 293
See application file for complete search history.

(56) References Cited

U.S. PATENT DOCUMENTS

| | | | | |
|---|---|---|---|---|
| 2,191,125 | A | 10/1937 | Douglas | |
| 2,719,125 | A | 9/1955 | Roberts | |
| 2,719,126 | A | 9/1955 | Fields et al. | |
| 2,749,311 | A | 6/1956 | Sabol et al. | |
| 3,087,932 | A | 4/1963 | Little, Jr. | |
| 3,087,937 | A | 4/1963 | Girogio et al. | |
| 3,663,561 | A | 5/1972 | Blaha | |
| 4,029,588 | A | 6/1977 | Koch | |
| 4,612,129 | A | 9/1986 | DiBiase et al. | |
| 4,943,672 | A | 7/1990 | Hamner et al. | |
| 5,344,579 | A | 9/1994 | Ohtani et al. | |
| 5,411,559 | A * | 5/1995 | Malfer | 44/347 |
| 6,013,171 | A | 1/2000 | Cook et al. | |
| 6,080,301 | A | 6/2000 | Berlowitz et al. | |
| 6,096,940 | A | 8/2000 | Wittenbrink et al. | |
| 6,103,099 | A | 8/2000 | Wittenbrink et al. | |
| 6,165,949 | A | 12/2000 | Berlowitz et al. | |
| 6,180,575 | B1 | 1/2001 | Nipe | |
| 6,528,458 | B1 * | 3/2003 | Tagliamonte et al. | 508/185 |
| 6,548,458 | B2 * | 4/2003 | Loper | 508/291 |
| 2005/0124508 | A1 * | 6/2005 | Iyer et al. | 508/273 |
| 2006/0063685 | A1 * | 3/2006 | Purmer et al. | 508/273 |
| 2006/0264339 | A1 * | 11/2006 | Devlin et al. | 508/188 |
| 2006/0264341 | A1 * | 11/2006 | Culley | 508/271 |
| 2008/0020950 | A1 * | 1/2008 | Gray et al. | 508/149 |
| 2010/0137173 | A1 * | 6/2010 | Sheets et al. | 508/192 |
| 2010/0160191 | A1 * | 6/2010 | Butke et al. | 508/186 |

* cited by examiner

*Primary Examiner* — Ellen McAvoy
(74) *Attorney, Agent, or Firm* — Luedeka Neely Group, P.C.

(57) ABSTRACT

A lubricant composition, a multi-vehicle transmission fluid, and a method for making a transmission fluid. The lubricant composition includes a) a base oil; b) 2,5-dimercapto-1,3,4-thiadiazole (DMTD), a derivative of DMTD, or mixtures thereof; and c) a friction modifier. The friction modifier is made by reacting an olefin containing at least 40% by weight $C_{10}$-$C_{36}$ vinylidene olefin with maleic acid, anhydride, or ester to provide a first reaction product, and aminating the first reaction product with an effective amount of a compound containing basic nitrogen to provide the friction modifier. The $C_{10}$-$C_{36}$ vinylidene olefin is represented by the following formula:

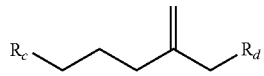

wherein $R_c$ and $R_d$ are independently a ($C_3$-$C_{15}$) alkyl, cycloalkyl or cycloalkenyl.

17 Claims, No Drawings

MULTI-VEHICLE AUTOMATIC TRANSMISSION FLUID

FIELD

The present disclosure relates to lubricating compositions, additive packages, and methods for lubricating a transmission, particularly lubricating fluids that meet or exceed vehicle transmission fluid specifications for different makes of vehicles.

BACKGROUND AND SUMMARY

A transmission system for a vehicle is suitably configured to deliver improved power transmitting efficiency, and improved fuel efficiency. Transmission mechanisms may include a manual transmission, a conventional stepped automatic transmission, a continuously variable transmission, a double clutch transmission, or other type of vehicle transmission. Such transmissions are typically used with conventional gasoline or diesel engine systems.

As newer, more fuel efficient vehicles are being developed there is an ever changing need for more versatile lubricating and power transmission fluids. Furthermore, different manufacturers have different criteria or specifications for the performance of the transmission fluids that are suitable for use in their vehicle's transmissions. In a transmission fluid, friction durablity and anti-shudder performance are important characteristics of the fluid. However, additives that improve one property of the fluid may be detrimental to another property of the fluid. For example, increasing the amount of friction modifier in a transmission fluid in order to improve the friction durability of the fluid may detrimentally increase the Brookfield viscosity (BV) of the fluid an undesirable amount so that the fluid no longer meets the required low temperature viscosity limits. Hence, there is a need for a single fluid that can be adapted for use in a variety of vehicle types and manufacturers, yet meet the manufacturer's specifications.

In view of the foregoing, embodiments of the disclosure provide a lubricant composition, a multi-vehicle transmission fluid containing the lubricant composition, and a method for making a transmission fluid including the lubricant composition. The lubricant composition includes a) a base oil; b) 2,5-dimercapto-1,3,4-thiadiazole (DMTD), a derivative of DMTD, or mixtures thereof; and c) a friction modifier. The friction modifier is made by reacting an olefin containing at least 40% by weight $C_{10}$-$C_{36}$ vinylidene olefin with maleic acid, anhydride, or ester to provide a first reaction product, and aminating the first reaction product with an effective amount of a compound containing basic nitrogen to provide the friction modifier. The $C_{10}$-$C_{36}$ vinylidene olefin is represented by the following formula:

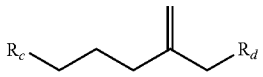

wherein $R_c$ and $R_d$ are independently a ($C_3$-$C_{15}$) alkyl, cycloalkyl or cycloalkenyl.

Another embodiment of the disclosure provides a transmission for a vehicle containing a lubricating fluid. The lubricating fluid includes a) a base oil; b) 2,5-dimercapto-1,3,4-thiadiazole (DMTD), a derivative of DMTD, or mixtures thereof; and c) a friction modifier. The friction modifier is made by reacting an olefin containing at least 40% by weight of a $C_{10}$-$C_{36}$ vinylidene olefin with maleic acid, anhydride, or ester to provide a first reaction product, and aminating the first reaction product with an effective amount of a compound containing basic nitrogen to provide a the friction modifier. The $C_{10}$-$C_{36}$ vinylidene olefin is represented by the following formula:

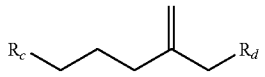

wherein $R_c$ and $R_d$ are independently a ($C_3$-$C_{15}$) alkyl, cycloalkyl or cycloalkenyl. The lubricating fluid for the transmission may be prepared using the lubricant composition or the transmission fluid of the disclosed embodiments, thus it may comprise, or be identical with, the lubricant composition or transmission fluid.

Other embodiments of the disclosure provide a transmission fluid and a method for providing a specific multi-vehicle transmission fluid of the disclosed embodiments. The method includes blending an oil of lubricating viscosity with: i) from about 100 to about 2000 ppm by weight 2,5-dimercapto-1,3,4-thiadiazole (DMTD), a derivative of DMTD, or mixtures thereof in terms of sulfur content of the transmission fluid derived from component (i); and ii) from about 50 to about 800 ppm friction modifier in terms of nitrogen content based on a total weight of the transmission fluid of a friction modifier. The friction modifier is made by reacting an olefin containing at least 40% by weight of a $C_{10}$-$C_{36}$ vinylidene olefin with maleic acid, anhydride, or ester to provide a first reaction product, and aminating the first reaction product with an effective amount of a compound containing basic nitrogen to provide the friction modifier. The $C_{10}$-$C_{36}$ vinylidene olefin is represented by the following formula:

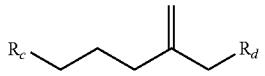

wherein $R_c$ and $R_d$ are independently a ($C_3$-$C_{15}$) alkyl, cycloalkyl or cycloalkenyl.

An advantage of the compositions and methods of the disclosure is that the fluids described herein containing the DMTD and the friction modifier are capable of providing the fluid with at least one, and preferably all three, of: reduced low temperature Brookfield viscosity, improved yellow metal protection and superior corrosion protection and improved friction durability. Specifically, this may be exemplified by at least one, and preferably all three, of: a low temperature Brookfield viscosity (BV) at −40° C. of less than 14,000 centipoise (cp), a weight percent lead loss in an aluminum beaker oxidation test of less than 0.5 wt. %, and a friction durability in a low velocity friction apparatus at 40° C. of greater than 300 hours. In addition, the compositions and methods of the disclosure are capable of providing exceptional high static friction performance in an SAE No. 2 friction rig while also maintaining the Brookfield, LVFA, and lead loss performance described above.

Additional features and advantages of the disclosure may be set forth in part in the description which follows, and/or may be learned by practice of the disclosure. The features and advantages of the disclosure may be further realized and attained by means of the elements and combinations particularly pointed out in the appended claims.

It is to be understood that both the foregoing general description and the following detailed description are exemplary and explanatory only and are not restrictive of the disclosure, as claimed.

DESCRIPTION OF THE EMBODIMENTS

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents such as pyridyl, furyl, thienyl, and imidazolyl. In general, no more than two, for example, no more than one, non-hydrocarbon substituent will be present for every ten carbon atoms in the hydrocarbyl group; typically, there will be no non-hydrocarbon substituents in the hydrocarbyl group.

As used herein, the term "percent by weight", unless expressly stated otherwise, means the percentage the recited component represents with respect to the total weight of the composition containing the recited component.

The terms "oil-soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

It is to be understood that throughout the present disclosure, the terms "comprises," "includes," etc. expressly consider and comprise both individual cases: the case wherein the following member, component, ingredient, or list of members, components, ingredients, etc. is a closed list, such as generally defined by the terms "consists of" or "consists essentially of," and wherein it is an open list, allowing further members, components, ingredients, etc. to be included in addition to the explicitly mentioned members, components, ingredients, etc.

Base Oil

Base oils suitable for use in formulating lubricant compositions, lubricating fluids, or transmission fluids according to the disclosure may be selected from any of suitable synthetic or natural oils or mixtures thereof having a suitable lubricating viscosity. Natural oils may include animal oils and vegetable oils (e.g., castor oil, lard oil) as well as mineral lubricating oils such as liquid petroleum oils and solvent treated or acid-treated mineral lubricating oils of the paraffinic, naphthenic or mixed paraffinic-naphthenic types. Oils derived from coal or shale may also be suitable. The base oil typically may have a viscosity of about 2 to about 15 cSt or, as a further example, about 2 to about 10 cSt at 100° C. Further, an oil derived from a gas-to-liquid process is also suitable.

Suitable synthetic base oils may include alkyl esters of dicarboxylic acids, polyglycols and alcohols, poly-alpha-olefins, including polybutenes, alkyl benzenes, organic esters of phosphoric acids, and polysilicone oils. Synthetic oils include hydrocarbon oils such as polymerized and interpolymerized olefins (e.g., polybutylenes, polypropylenes, propylene isobutylene copolymers, etc.); poly(1-hexenes), poly-(1-octenes), poly(1-decenes), etc. and mixtures thereof; alkylbenzenes (e.g., dodecylbenzenes, tetradecylbenzenes, di-nonylbenzenes, di-(2-ethylhexyl)benzenes, etc.); polyphenyls (e.g., biphenyls, terphenyl, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic oils that may be used. Such oils are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500-1000, diethyl ether of polypropylene glycol having a molecular weight of about 1000-1500, etc.) or mono- and polycarboxylic esters thereof, for example, the acetic acid esters, mixed $C_3$-$C_8$ fatty acid esters, or the $C_{13}$ oxo-acid diester of tetraethylene glycol.

Another class of synthetic oils that may be used includes the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Hence, the base oil used which may be used to make the engine lubricant compositions as described herein may be a single base oil or may be a mixture of two or more base oils. In particular, the one or more base oil(s) may desirably be selected from any of the base oils in Groups I-V as specified in the American Petroleum Institute (API) Base Oil Interchangeability Guidelines. Such base oil groups are as follows:

TABLE 1

| Base Oil Group[1] | Sulfur (wt %) | | Saturates (wt %) | Viscosity Index |
|---|---|---|---|---|
| Group I | >0.03 | And/or | <90 | 80 to 120 |
| Group II | ≦0.03 | And | ≧90 | 80 to 120 |
| Group III | ≦0.03 | And | ≧90 | ≧120 |
| Group IV | all polyalphaolefins (PAOs) | | | |
| Group V | all others not included in Groups I-IV | | | |

[1]Groups I-III are mineral oil base stocks.

The base oil may contain a minor or major amount of a poly-alpha-olefin (PAO). Typically, the poly-alpha-olefins are derived from monomers having from about 4 to about 30, or from about 4 to about 20, or from about 6 to about 16 carbon atoms. Examples of useful PAOs include those derived from octene, decene, mixtures thereof, and the like. PAOs may have a viscosity of from about 2 to about 15, or from about 3 to about 12, or from about 4 to about 8 cSt at 100° C. Examples of PAOs include 4 cSt at 100° C. poly-alpha-olefins, 6 cSt at 100° C. poly-alpha-olefins, and mixtures thereof. Mixtures of mineral oil with the foregoing poly-alpha-olefins may be used.

The base oil may be an oil derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. For example, the hydrocarbons may be hydroisomerized using processes disclosed in U.S. Pat. No. 6,103,099 or 6,180,575; hydrocracked and hydroisomerized using processes disclosed in U.S. Pat. No. 4,943,672 or 6,096,940; dewaxed using processes disclosed in U.S. Pat. No. 5,882,505; or hydroisomerized and dewaxed using processes disclosed in U.S. Pat. Nos. 6,013,171; 6,080,301; or 6,165,949.

Unrefined, refined, and rerefined oils, either natural or synthetic (as well as mixtures of two or more of any of these) of the type disclosed hereinabove can be used in the base oils. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives, contaminants, and oil breakdown products.

The base oil may be combined with an additive composition as disclosed in embodiments herein to provide multi-vehicle transmission fluids. Accordingly, the base oil may be present in the fluid composition described herein in an amount ranging from more than about 30 wt. % to about 95 wt. %, for example, from about 40 wt % to about 90 wt. %, and typically more than about 50 wt. % based on a total weight of the fluid composition.

Extreme Pressure/Antiwear Additive

In embodiments of the disclosure, a sulfur-containing extreme pressure/antiwear additive component may be added to the base oil to provide a particular sulfur content to the lubricant formulation. Sulfur-containing extreme pressure/antiwear additives include, but are not limited to thiazoles, triazoles and thiadiazoles. Examples of such compounds include benzotriazole, tolyltriazole, octyltriazole, decyltriazole, dodecyltriazole, 2-mercapto benzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-bis(hydrocarbyldithio)-1,3,4-thiadiazoles. An essential feature of the disclosed embodiments is the presence of 2,5-dimercapto-1,3,4-thiadiazole (DMTD), derivatives of DMTD, or mixtures thereof in the lubricant composition, and/or the lubricating fluid, and/or the transmission fluid. Derivatives of DMTD include, but are not limited to 2-hydrocarbyldithio-5-mercapto-1,3,4-thiadiazole or 2,5-bis-(hydrocarbyldithio)-1,3,4-thiadiazole and mixtures thereof; carboxylic esters of DMTD; condensation products of α-halogenated aliphatic monocarboxylic acids with DMTD; reaction products of unsaturated cyclic hydrocarbons and unsaturated ketones with DMTD; reaction products of an aldehyde and a diaryl amine with DMTD; amine salts of DMTD; dithiocarbamate derivatives of DMTD; reaction products of an aldehyde, and an alcohol or aromatic hydroxy compound, and DMTD; reaction products of an aldehyde, a mercaptan and DMTD; 2-hydrocarbylthio-5-mercapto-1,3,4-thiadiazole; and products from combining an oil soluble dispersant with DMTD; and mixtures thereof. Such compositions are described in U.S. Pat. No. 4,612,129 and patent references cited therein.

In some embodiments, the thiadiazoles for use in the transmission fluids described herein include 2,5-bis-(hydrocarbyldithio)-1,3,4-thiadiazole and its mono-substituted equivalent 2-hydrocarbylthio-5-mercapto-1,3,4-thiadiazole which is commercially available as a mixture of the two compounds in a ratio of about 85 percent bis-hydrocarbyl to 15 percent monohydrocarbyl.

U.S. Pat. Nos. 2,719,125; 2,719,126; and 3,087,937 describe the preparation of various 2,5-bis(hydrocarbyl dithio)-1,3,4-thiadiazoles, which are particularly desirable according to the disclosed embodiments. Therein each hydrocarbyl group may be linked to the thiadiazole through multiple sulfur atoms. The hydrocarbon group may be aliphatic or aromatic, including cyclic, alicyclic, aralkyl, aryl and alkaryl. The foregoing polysulfides may be represented by the following general formula:

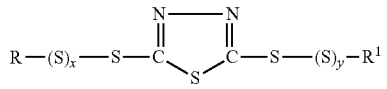

wherein R and $R^1$ may be the same or different hydrocarbon groups, and x and y be integers from 0 to about 8, and the sum of x and y being at least 1. A process for preparing such derivatives is described in U.S. Pat. No. 2,191,125; U.S. Pat. No. 3,087,932; and U.S. Pat. No. 2,749,311. The reactions referenced and described in the foregoing documents may produce some amount of the monohydrocarbyldithio-thiadiazole as well as the bis-hydrocarbyl compound. The ratio of the two may be adjusted by varying the amounts of the reactants.

The preparation of 2-hydrocarbyldithio-5-mercapto-1,3,4-thiadiazoles, particularly desirable according to the disclosed embodiments, having the formula

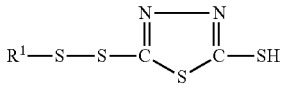

where $R^1$ is a hydrocarbyl substituent, is described in U.S. Pat. No. 3,663,561. The foregoing compositions may be made by the oxidative coupling of equimolecular portions of a hydrocarbyl mercaptan and DMTD or its alkali metal mercaptide. Mono-mercaptans that may be used in the preparation of such compounds are represented by the formula $R^1SH$ wherein $R^1$ is a hydrocarbyl group containing from 1 to about 28 carbon atoms. A peroxy compound, hypohalide, or air, or mixtures thereof, may be used to promote oxidative coupling. Specific examples of the mono-mercaptans include methyl mercaptan, isopropyl mercaptan, hexyl mercaptan, decyl mercaptan, and long chain alkyl mercaptans, for example, mercaptans derived from propene polymers and isobutylene polymers especially polyisobutylenes, having 3 to about 70 propene or isobutylene units per molecule.

The amount of sulfur provided by the sulfur-containing extreme pressure/antiwear additive component to the transmission fluid may range from about 100 to about 2000 ppm by weight based on a total weight of the transmission fluid. It is particularly desirable that the 2,5-dimercapto-1,3,4-thiadiazole (DMTD), derivatives of DMTD, or mixture thereof provides sulfur to the lubricant composition, lubricating fluid or transmission fluid in an amount ranging from about 100 to about 2000 ppm by weight, for example, from about 350 to 1000 ppm by weight, and more particularly from about 400 to 800 ppm by weight based on a total weight of the lubricant composition, lubricating fluid or transmission fluid, respectively.

Friction Modifiers

The second component combined with the extreme pressure/antiwear additive component described above includes a particular friction modifier. Friction modifiers are used in lubrication fluids as described herein to decrease or increase friction between surfaces (e.g., the members of a torque converter clutch or a shifting clutch) at low sliding speeds. Typically, the desired result is a friction-vs.-velocity (μ-v) curve that has a positive slope, which in turn leads to smooth clutch engagements minimizing "stick-slip" behavior (e.g., shudder, noise, and harsh shifts).

Friction modifiers include such compounds as aliphatic amines or ethoxylated aliphatic amines, ether amines, alkoxylated ether amines, aliphatic fatty acid amides, acylated amines, aliphatic carboxylic acids, aliphatic carboxylic esters, polyol esters, aliphatic carboxylic ester-amides, imidazolines, tertiary amines, aliphatic phosphonates, aliphatic phosphates, aliphatic thiophosphonates, aliphatic thiophosphates, etc., wherein the aliphatic group usually contains one or more carbon atoms so as to render the compound suitably oil soluble. As a further example, the aliphatic group may contain about 8 or more carbon atoms. Also suitable are aliphatic substituted succinimides formed by reacting one or more aliphatic succinic acids or anhydrides with ammonia primary amines.

The particular friction modifier required by the disclosed embodiments, which is an example of a particularly desirable succinimide derived friction modifier, is a friction modifier made by reacting an olefin containing at least 40% by weight of a $C_{10}$-$C_{36}$ vinylidene olefin with maleic acid, anhydride, or ester to provide a first reaction product. The first reaction product is then aminated with an effective amount of a compound containing basic nitrogen to provide the friction modifier. Friction modifier compounds made by the foregoing process are described in more detail in U.S. Publication No. 2010/0137173, the disclosure of which is incorporated herein by reference. In the foregoing reaction, the $C_{10}$-$C_{36}$ vinylidene olefin is represented by the following formula:

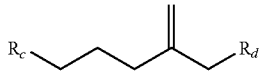

wherein $R_c$ and $R_d$ are independently a ($C_3$-$C_{15}$) alkyl, cycloalkyl or cycloalkenyl. According to the foregoing process, the $C_{10}$-$C_{36}$ vinylidene olefin is desirably converted to a more thermodynamically stable tri-substituted internal olefin by placing the $C_{10}$-$C_{36}$ vinylidene olefin under acid-catalysis conditions followed by treating the resulting olefin with maleic acid, anhydride, or ester under thermal conditions to induce an ene reaction.

Friction modifier compounds made using the foregoing $C_{10}$-$C_{36}$ vinylidene olefin may thus be prepared using the synthetic route outlined in Scheme I.

Scheme I

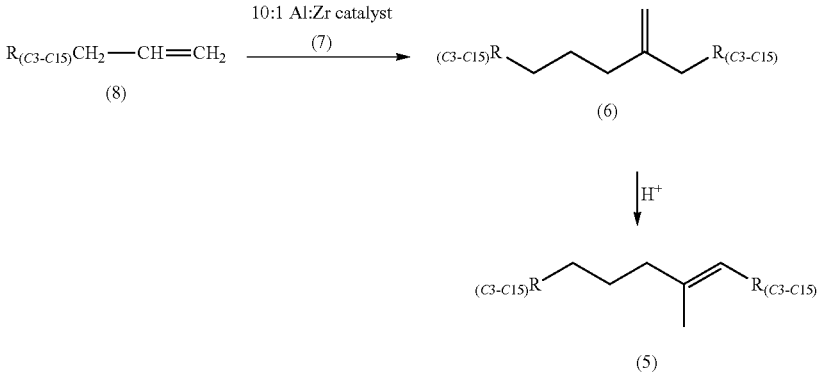

-continued

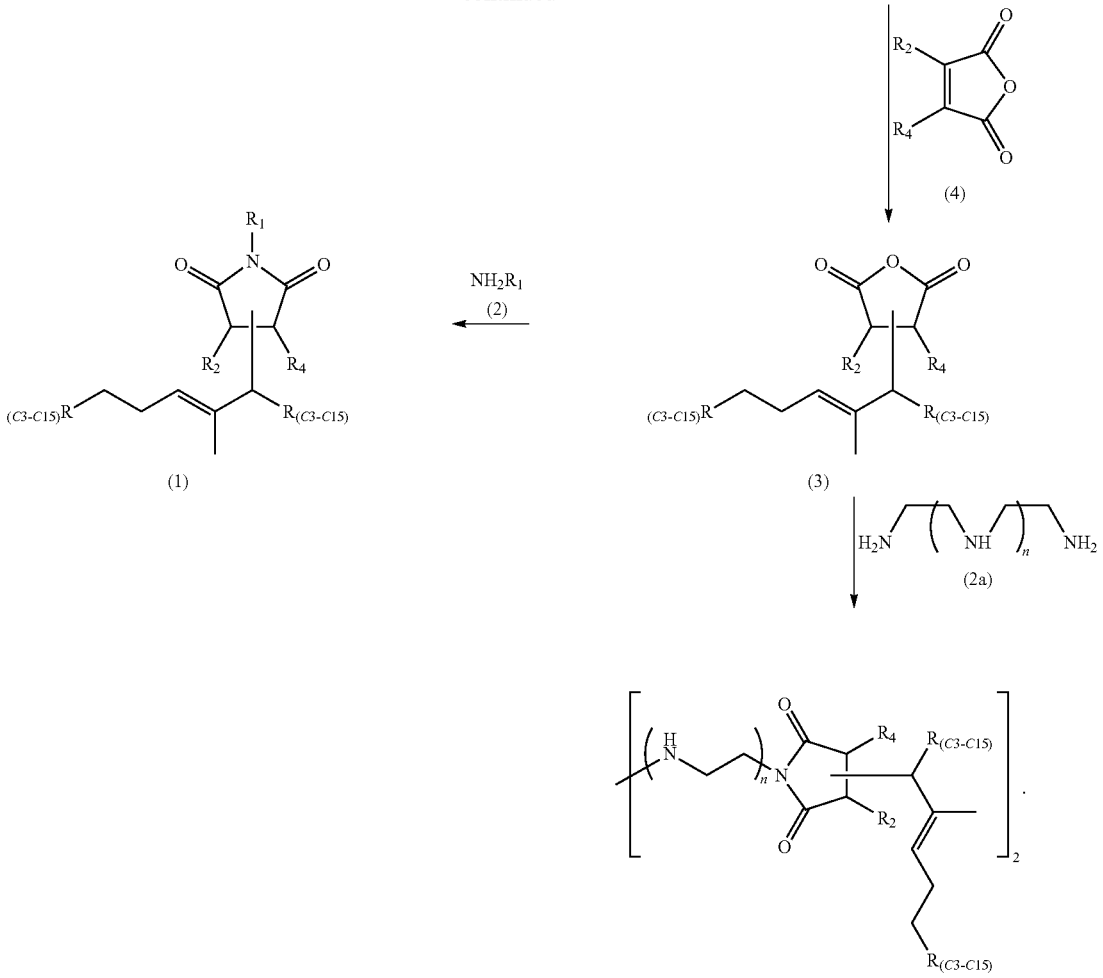

In the foregoing reaction scheme, the $C_{10}$-$C_{36}$ vinylidene olefin (6) is converted to a more thermodynamically stable tri-substituted internal olefin (5) by placing the vinylidene under acid-catalysis conditions. The resulting olefin is treated with a maleic anhydride (4), optionally substituted at the $R_2$ and $R_4$ positions, under thermal conditions to induce an "ene reaction" in a molar ratio of vinylidene olefin to maleic acid ranging from about 0.5:1 to about 1.5:1. The reaction product (3), an alkyl succinic anhydride having a vinyl methyl group, is freed from unreacted maleic anhydride by placing the reaction mixture under vacuum. An amination reaction may then be conducted at a suitable temperature conducive to promoting the reaction. The reaction mixture may be neutralized with an equivalent amount of base, e.g., ammonia gas or a substituted amine (2) at a suitable elevated temperature. The final product (1), an alkyl succinimide having a vinyl methyl group, is produced with overall yields at or above eighty (80) percent. Alternatively, the alkyl succinic anhydride (3) may be reacted with a polyamine type (2a) to provide a bis-succinimide (1a) with both succinimides substituted by alkyl groups containing a vinyl methyl group. The particular friction modifier of the disclosed embodiments is desirably present in the lubricant composition, transmission fluid, or lubricating fluid described herein in an amount that is sufficient to provide from about 50 to about 800 ppm, and desirably from about 150 to about 500 ppm by weight nitrogen to the transmission fluid based on a total weight of the lubricant composition, transmission fluid, or lubricating fluid.

In one embodiment, a weight ratio of nitrogen (ppm by weight) contributed by said succinimide-based friction modifier, to the sulfur (ppm by weight) contributed by said DMTD or DMTD derivative, or mixtures thereof, may range from about 0.2:1 to about 1.2:1, for example from about 0.25:1 to about 0.8:1, desirably from about 0.3:1 to about 0.7:1, or more suitably from about 0.45:1 to about 0.67:1 in order to optimize low temperature viscosity, oxidation resistance, and suitable friction durability, e.g. for use as a multi-vehicle transmission fluid.

Other friction modifier compounds may also be included in the transmission fluids described herein. For example, one group of friction modifiers includes the N-aliphatic hydrocarbyl-substituted diethanol amines in which the N-aliphatic hydrocarbyl-substituent is at least one straight chain aliphatic hydrocarbyl group free of acetylenic unsaturation and having in the range of about 14 to about 20 carbon atoms.

Another friction modifier that may be used is based on a combination of (i) at least one di(hydroxyalkyl) aliphatic tertiary amine in which the hydroxyalkyl groups, being the same or different, each contain from 2 to about 4 carbon atoms, and in which the aliphatic group is an acyclic hydrocarbyl group containing from about 10 to about 25 carbon atoms, and (ii) at least one hydroxyalkyl aliphatic imidazoline in which the hydroxyalkyl group contains from 2 to about 4 carbon atoms, and in which the aliphatic group is an acyclic hydrocarbyl group containing from about 10 to about 25 carbon atoms. For further details concerning this friction modifier system, reference should be had to U.S. Pat. No. 5,344,579.

Generally speaking, the lubricating compositions described herein may suitably contain up to about 2.5 wt. %, desirably from about 0.05 wt. % to about 2.2 wt. %, and in particular up to about 1.8 wt. %, or up to only about 1.25 wt %, or, as a further example, from about 0.75 to about 1 wt % of one or more total friction modifiers in the transmission fluid.

Other Optional Components

The transmission fluid described herein may also include conventional additives of the type used in automatic transmission fluid formulations in addition to the components described above. Such additives include, but are not limited to, dispersant additive, detergent additive, antioxidants, corrosion inhibitors, antirust additives, metal deactivators, antifoamants, pour point depressants, air entrainment additives, seal swell agents, and the like.

Dispersant Additive

A dispersant additive that may be used may be a reaction product of a hydrocarbyl-dicarboxylic acid or anhydride and a polyamine. The hydrocarbyl moiety of the hydrocarbyl-dicarboxylic acid or anhydride of may be derived from butene polymers, for example polymers of isobutylene. Suitable polyisobutenes for use herein include those formed from polyisobutylene or highly reactive polyisobutylene having at least about 60%, such as about 70% to about 90% and above, terminal vinylidene content. Suitable polyisobutenes may include those prepared using $BF_3$ catalysts. The average number molecular weight of the polyalkenyl substituent may vary over a wide range, for example from about 100 to about 5000, such as from about 500 to about 5000, as determined by gel permeation chromatography (GPC) as described above.

The dicarboxylic acid or anhydride of may be selected from carboxylic reactants other than maleic anhydride, such as maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and lower aliphatic esters. A mole ratio of maleic anhydride to hydrocarbyl moiety in a reaction mixture used to make the hydrocarbyl-dicarboxylic acid or anhydride may vary widely. Accordingly, the mole ratio may vary from about 5:1 to about 1:5, for example from about 3:1 to about 1:3. A particularly suitable molar ratio of anhydride to hydrocarbyl moiety is from about 1:1 to less than about 1.6:1.

Any of numerous polyamines can be used as in preparing the dispersant additive. Non-limiting exemplary polyamines may include aminoguanidine bicarbonate (AGBC), diethylene triamine (DETA), triethylene tetramine (TETA), tetraethylene pentamine (TEPA), pentaethylene hexamine (PEHA) and heavy polyamines. A heavy polyamine may comprise a mixture of polyalkylenepolyamines having small amounts of lower polyamine oligomers such as TEPA and PEHA, but primarily oligomers having seven or more nitrogen atoms, two or more primary amines per molecule, and more extensive branching than conventional polyamine mixtures. Additional non-limiting polyamines which may be used to prepare the hydrocarbyl-substituted succinimide dispersant are disclosed in U.S. Pat. No. 6,548,458, the disclosure of which is incorporated herein by reference in its entirety. In an embodiment of the disclosure, the polyamine may be selected from tetraethylene pentamine (TEPA).

In an embodiment, the dispersant additive may be a compounds of formula (I):

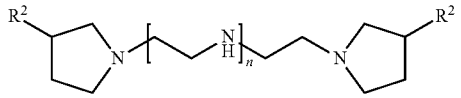

(I)

wherein n represents 0 or an integer of from 1 to 5, and $R^2$ is a hydrocarbyl substituent as defined above. In an embodiment, n is 3 and $R^2$ is a polyisobutenyl substituent, such as that derived from polyisobutylenes having at least about 60%, such as about 70% to about 90% and above, terminal vinylidene content. Compounds of formula (I) may be the reaction product of a hydrocarbyl-substituted succinic anhydride, such as a polyisobutenyl succinic anhydride (PIBSA), and a polyamine, for example tetraethylene pentamine (TEPA).

The foregoing compound of formula (I) may have a molar ratio of (A) polyisobutenyl-substituted succinic anhydride to (B) polyamine in the range of about 4:3 to about 1:10 in the compound. A particularly useful dispersant contains polyisobutenyl group of the polyisobutenyl-substituted succinic anhydride having a number average molecular weight (Mn) in the range of from about 500 to 5000 as determined by GPC and a (B) polyamine having a general formula $H_2N(CH_2)_m$—$[NH(CH_2)_m]_n$—$NH_2$, wherein m is in the range from 2 to 4 and n is in the range of from 1 to 2.

The dispersant additive described herein may be boronated and/or phosphorylated. Accordingly, in one embodiment, the dispersant additive has a nitrogen content up to 10,000 ppm by weight, for example from about 0.5 to about 0.8 wt. % and a boron plus phosphorus to nitrogen ((B+P)/N) weight ratio of from 0:1 to about 0.8:1. The amount of dispersant in the fluid composition may range from about 300 to about 1000 ppm by weight for example, from about 400 to about 900 ppm by weight in terms of nitrogen based on a total weight of the lubricant composition.

Metal Detergent

Metal detergents that may be included in the transmission fluids described herein may generally comprise a polar head with a long hydrophobic tail where the polar head comprises a metal salt of an acidic organic compound. The salts may contain a substantially stoichiometric amount of the metal, in which case they are usually described as normal or neutral salts, and would typically have a total base number or TBN (as measured by ASTM D2896) of from about 0 to less than about 150. Large amounts of a metal base may be included by reacting an excess of a metal compound such as an oxide or hydroxide with an acidic gas such as carbon dioxide. The resulting overbased detergent comprises micelles of neutralized detergent surrounding a core of inorganic metal base (e.g., hydrated carbonates). Such overbased detergents may have a TBN of about 150 or greater, such as from about 150 to about 450 or more.

Detergents that may be suitable for use in the present embodiments include oil-soluble overbased, low base, and neutral sulfonates, phenates, sulfurized phenates, and salicylates of a metal, particularly the alkali or alkaline earth metals, e.g., sodium, potassium, lithium, calcium, and magnesium. More than one metal may be present, for example, both calcium and magnesium. Mixtures of calcium and/or magnesium with sodium may also be suitable. Suitable metal detergents may be overbased calcium or magnesium sulfonates having a TBN of from 150 to 450 TBN, overbased calcium or magnesium phenates or sulfurized phenates having a TBN of from 150 to 300 TBN, and overbased calcium or magnesium salicylates having a TBN of from 130 to 350. Mixtures of such salts may also be used.

The metal-containing detergent may be present in a lubricating composition in an amount sufficient to improve the anti-rust performance of the lubricating fluid. For example, the amount of detergent in the lubricating fluid composition may range from about 0.5 wt % to about 5 wt %. As a further example, the metal-containing detergent may be present in an amount of from about 1.0 wt % to about 3.0 wt %. The metal-containing detergent may be present in a lubricating composition in an amount sufficient to provide from about 10 to about 5000 ppm alkali and/or alkaline earth metal to the lubricant composition based on a total weight of the lubricant composition. As a further example, the metal-containing detergent may be present in a lubricating composition in an amount sufficient to provide from about 40 to about 900 ppm alkali and/or alkaline earth metal. A particularly suitable amount of detergent in the lubricating fluid composition may provide from about 60 to about 600 ppm of alkali and/or alkaline earth metal to the lubricating fluid composition.

Corrosion Inhibitors

Rust or corrosion inhibitors may also be included in the transmission fluids described herein. Such materials include monocarboxylic acids and polycarboxylic acids. Examples of suitable monocarboxylic acids are octanoic acid, decanoic acid and dodecanoic acid. Suitable polycarboxylic acids include dimer and trimer acids such as are produced from such acids as tall oil fatty acids, oleic acid, linoleic acid, or the like.

Another useful type of rust inhibitor may comprise alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Other suitable rust or corrosion inhibitors include ether amines; acid phosphates; amines; polyethoxylated compounds such as ethoxylated amines, ethoxylated phenols, and ethoxylated alcohols; imidazolines; aminosuccinic acids or derivatives thereof, and the like. Mixtures of such rust or corrosion inhibitors may be used. The total amount of corrosion inhibitor in the transmission fluid formulations described herein may range from about 0.01 to about 2.0 wt % based on the total weight of the formulation.

Antioxidants

In some embodiments, antioxidant compounds may be included in the lubricating compositions described herein. Antioxidants include phenolic antioxidants, aromatic amine antioxidants, sulfurized phenolic antioxidants, and organic phosphites, among others. Examples of phenolic antioxidants include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl6-ter-t-butylphenol), mixed methylene-bridged polyalkyl phenols, and 4,4'-thiobis(2-methyl-6-tert-butylphenol). N,N'-di-sec-butyl-phenylenediamine, 4-isopropylamino-diphenylamine, phenyl-.alpha.-naphthyl amine, phenyl-.alpha.-naphthyl amine, and ring-alkylated diphenylamines. Examples include the sterically hindered tertiary butylated phenols, bisphenols and cinnamic acid derivatives and combinations thereof.

Aromatic amine antioxidants include, but are not limited to diarylamines having the formula:

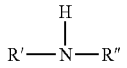

wherein R' and R" each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups.

The aryl group is preferably substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. It is preferred that one or both aryl groups be substituted, e.g. mono-alkylated diphenylamine, di-alkylated diphenylamine, or mixtures of mono- and di-alkylated diphenylamines.

Examples of diarylamines that may be used include, but are not limited to: diphenylamine; various alkylated diphenylamines; 3-hydroxydiphenylamine; N-phenyl-1,2-phenylenediamine; N-phenyl-1,4-phenylenediamine; monobutyldiphenyl-amine; dibutyldiphenylamine; monooctyldiphenylamine; dioctyldiphenylamine; monononyldiphenylamine; dinonyldiphenylamine; monotetradecyldiphenylamine; ditetradecyldiphenylamine, phenyl-alpha-naphthylamine; monooctyl phenyl-alpha-naphthylamine; phenyl-beta-naphthylamine; monoheptyldiphenylamine; diheptyl-diphenylamine; p-oriented styrenated diphenylamine; mixed butyloctyldi-phenylamine; and mixed octylstyryldiphenylamine.

The sulfur containing antioxidants include, but are not limited to, sulfurized olefins that are characterized by the type of olefin used in their production and the final sulfur content of the antioxidant. High molecular weight olefins, i.e. those olefins having an average molecular weight of 168 to 351 g/mole, are preferred. Examples of olefins that may be used include alpha-olefins, isomerized alpha-olefins, branched olefins, cyclic olefins, and combinations of these.

Alpha-olefins include, but are not limited to, any $C_4$ to $C_{25}$ alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is a branched olefin counterpart of the alpha-olefin 1-butene.

Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soybean oil, sunflower seed oil, tallow, and combinations of these.

The amount of sulfurized olefin or sulfurized fatty oil delivered to the finished lubricant is based on the sulfur content of the sulfurized olefin or fatty oil and the desired level of sulfur to be delivered to the finished lubricant. For example, a sulfurized fatty oil or olefin containing 20 weight % sulfur, when added to the finished lubricant at a 1.0 weight % treat level, will deliver 2000 ppm of sulfur to the finished lubricant. A sulfurized fatty oil or olefin containing 10 weight % sulfur, when added to the finished lubricant at a 1.0 weight % treat level, will deliver 1000 ppm sulfur to the finished lubricant. It is desirable that the sulfurized olefin or sulfurized fatty oil to deliver between 200 ppm and 2000 ppm sulfur to the finished lubricant. The total amount of antioxidant in the lubricating fluid compositions described herein may range from about 0.01 to about 3.0 wt % based on the total weight of the fluid composition. As a further example, antioxidant may be present in an amount from about 0.1 wt % to about 1.0 wt %.

Seal Swell Agents

The lubricating composition described herein may optionally contain seal swell agents such as alcohols, alkylbenzenes, substituted sulfolanes or mineral oils that cause swelling of elastomeric materials. Alcohol-type seal swell agents are low volatility linear alkyl alcohols. Examples of suitable alcohols include decyl alcohol, tridecyl alcohol and tetradecyl alcohol. Examples of alkylbenzenes useful as seal swell agents for use in conjunction with the compositions described herein include dodecylbenzenes, tetradecylbenzenes, dinonyl-benzenes, di(2-ethylhexyl)benzene, and the like. Examples of substituted sulfolanes are described in U.S. Pat. No. 4,029,588, incorporated herein by reference. Mineral oils useful as seal swell agents are typically low viscosity mineral oils with high naphthenic or aromatic content. When used in the lubricating composition described herein, a seal swell agent will typically comprise from about 1 to about 30 wt. %, preferably from about 2 to about 20 wt. %, most preferably from about 5 to about 15 wt. %, based on the total weight of the lubricating composition.

Anti-Foam Agents

In some embodiments, a foam inhibitor may form another component suitable for use in the lubricating compositions described herein. Foam inhibitors may be selected from silicones, polyacrylates, and the like. The amount of antifoam agent in the engine lubricant formulations described herein may range from about 0.001 wt % to about 0.1 wt % based on the total weight of the formulation. As a further example, antifoam agent may be present in an amount from about 0.004 wt % to about 0.10 wt %.

Additives used in formulating the compositions described herein can be blended into the base oil individually or in various sub-combinations. However, it is suitable to blend all of the components concurrently using an additive concentrate (i.e., additives plus a diluent, such as a hydrocarbon solvent). The use of an additive concentrate takes advantage of the mutual compatibility afforded by the combination of ingredients when in the form of an additive concentrate. Also, the use of a concentrate reduces blending time and lessens the possibility of blending errors.

In general terms, a suitable lubricating fluid may include additive components in the ranges listed in the following table.

TABLE 2

| Component | Wt. % (Broad) | Wt. % (Typical) |
|---|---|---|
| Dispersant additive | 0.5-20.0 | 1.0-15.0 |
| Antioxidants | 0-2.0 | 0.01-1.0 |
| Metal Detergents | 0.1-10.0 | 0.5-5.0 |
| Corrosion Inhibitor | 0-5.0 | 0-2.0 |
| Extreme pressure/antiwear agents | 0.01-5.0 | 0.1-2.0 |
| Antifoaming agents | 0-1.0 | 0.001-0.1 |
| Pour point depressant | 0.001-1.0 | 0.01-0.5 |
| Friction modifiers | 0-2.0 | 0.05-1.0 |
| Seal swell agents | 0-10.0 | 0.5-5.0 |
| Viscosity index improvers | 0-30 | 5.0-15 |
| Base oil | Balance | Balance |
| Total | 100 | 100 |

Examples

The following non-limiting examples are provided in order to further illustrate the features and advantages of one or more embodiments of the disclosure. All of the fluids tested in the following table included the components as shown in Table 2 in order to provide a fully formulated lubricating fluid composition. In the table, the extreme pressure/antiwear agent (DMTD) was a commercially available mixture of 2,5-bis-(hydrocarbyldithio)-1,3,4-thiadiazole and its mono-substituted equivalent, 2-hydrocarbylthio-5-mercapto-1,3,4-thiadiazole, having a ratio of about 85 percent bis-hydrocarbyl to 15 percent monohydrocarbyl referred to in the table as "Thiadiazole." Friction modifier (FM1), a particular modifier of the disclosed embodiments, was made with a mixture of olefins where at least 40% by weight of the olefin was a $C_{10}$-$C_{36}$ vinylidene olefin as described above and friction modifier (FM2) was made with a conventional, linear α-olefin. All of the weights of components in the table are by weight of the component in the finished lubricant composition.

TABLE 3

| Formulation | Ex. 1. | Ex. 2 | Ex. 3 | Comp. Ex. 1 | Comp. Ex. 2 | Comp. Ex. 3 | Comp. Ex. 4 | Comp. Ex. 5 | Comp. Ex. 6 | Comp. Ex. 7 |
|---|---|---|---|---|---|---|---|---|---|---|
| DMTD (wt. %) | 0.2 | 0.168 | 0.168 | 0.09 | 0.2 | 0.09 | 0.168 | 0.168 | 0.168 | 0.41 |
| S contributed by DMTD (ppm by weight) | 700 | 588 | 588 | 315 | 700 | 315 | 588 | 588 | 588 | 1435 |
| N contributed by DMTD (ppm by weight) | 128 | 107 | 107 | 57.6 | 128 | 57.6 | 107 | 107 | 107 | 262 |
| FM1 (wt. %) | 2 | 1.6 | 0.8 | 0 | 0 | 2 | 4 | 0 | 0 | 4 |
| N contributed by FM1 (ppm by weight) | 480 | 384 | 192 | 0 | 0 | 480 | 960 | 0 | 0 | 960 |
| FM2 (wt. %) | 0.095 | 0.0798 | 0.0798 | 0.095 | 0.59 | 0.095 | 0.0798 | 1.6798 | 0.8798 | 0.0798 |
| N contributed by FM2 (ppm by weight) | 26.7 | 22.3 | 22.3 | 26.6 | 165.2 | 26.6 | 22.3 | 470 | 246 | 22.3 |
| Total FM (FM1 + FM2) (wt. %) | 2.095 | 1.68 | 0.88 | 0.095 | 0.59 | 2.095 | 4.08 | 1.68 | 0.88 | 4.08 |
| N contributed by Total FM (FM1 + FM2) (ppm by weight) | 507 | 406 | 214 | 26.6 | 165 | 507 | 982 | 470 | 246 | 982 |
| Ratio N/S (FM1/DMTD) | 0.686 | 0.653 | 0.327 | 0.000 | 0.000 | 1.524 | 1.633 | 0.000 | 0.000 | 0.669 |

TABLE 3-continued

| Formulation | Ex. 1. | Ex. 2 | Ex. 3 | Comp. Ex. 1 | Comp. Ex. 2 | Comp. Ex. 3 | Comp. Ex. 4 | Comp. Ex. 5 | Comp. Ex. 6 | Comp. Ex. 7 |
|---|---|---|---|---|---|---|---|---|---|---|
| Properties | | | | | | | | | | |
| BV(−40° C.) (<14,000 cp) | 12046 | 11694 | 11703 | 11758 | 9040 | 12035 | 24,000 | 19,536 | 14,517 | 22,700 |
| ABOT 100 HR, % PB COUPON WEIGHT LOSS (<0.5 wt %) | 0.1 | 0 | 0 | 0 | 0 | 1.2 | 1.7 | N/A | N/A | 0.0 |
| LVFA Durability (dμ/dV × 1000 (0.9, 150 rpm) at 40° C.) (>300 hrs) | >300 hrs | 528 hrs | 384 hrs | 100 hrs | 240 hrs | N/A | N/A | N/A | N/A | N/A |

As shown by the working examples, in particular Examples 2 and 3, use of a particular combination of DMTD and FM1 is effective to provide a low temperature Brookfield viscosity (BV) at −40° C.) of less than 14,000 cp, an aluminum beaker oxidation test (ABOT) of less than 0.5 wt. % coupon lead loss, and a low velocity friction apparatus (LVFA) durability of greater than 300 hours. In Examples 1-3, the sulfur contributed by the DMTD was 588 to 700 ppm by weight and the nitrogen contributed by the FM1 was 192 to 480 ppm by weight giving a ratio of N/S (FM1/DMTD) of from 0.327 to 0.686.

In Comparative Examples 1 and 2 (Comp. Ex. 1 and Comp. Ex. 2) the lubricant compositions contained no FM1 resulting in an N/S ratio of 0. Accordingly, while the BV at −40° C. and the ABOT weight loss were within range, the durability of the fluid was less than the minimum of 300 hours. In Comparative Examples 5 and 6 (Comp. Ex. 5 and Comp. Ex. 6) the amount of FM2 was increased in an attempt to compensate for the lack of FM1 in the lubricant compositions. However, Comp. Ex. 5 and Comp. Ex. 6 both had too high a low temperature viscosity (BV −40° C.) and thus the ABOT and LVFA were not run.

In Comparative Example 4 (Comp. Ex. 4) and Comparative Example 7 (Comp. Ex. 7), the amount of nitrogen contributed by the FM1 was greater than about 800 resulting in too high a low temperature viscosity (BV −40° C.). In Comparative Example 3 (Comp. Ex. 3) and Comp. Ex. 4, the ratio of N/S was too high resulting in too great an ABOT weight loss.

Other embodiments of the present disclosure will be apparent to those skilled in the art from consideration of the specification and practice of the invention disclosed herein. As used throughout the specification and claims, "a" and/or "an" may refer to one or more than one. Unless otherwise indicated, all numbers expressing quantities of ingredients, properties such as molecular weight, percent, weight percent, ratio, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not as an attempt to limit the application by the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the invention being indicated by the following claims.

What is claimed is:

1. A lubricant composition for a transmission fluid comprising:

a). a base oil;

b). 2,5-dimercapto-1,3,4-thiadiazole (DMTD), a derivative of DMTD, or mixtures thereof;

c). a friction modifier made by:

i). reacting an olefin, wherein at least 40% by weight of the olefin is a $C_{10}$-$C_{36}$ vinylidene olefin that was reacted under acid-catalysis condition then treated with maleic acid, anhydride, or ester to provide a first reaction product; and ii). aminating the reaction product with an effective amount of a compound containing basic nitrogen to provide the friction modifier, wherein $C_{10}$-$C_{36}$ vinylidene olefin is represented by the following formula:

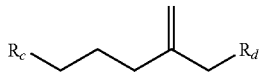

wherein $R_c$ and $R_d$ are independently a ($C_3$-$C_{15}$) alkyl, cycloalkyl or cycloalkenyl, wherein the friction modifier (c) provides from about 50 to about 800 ppm by weight of nitrogen to the lubricant composition based on a total weight of the lubricant composition and wherein a weight ratio of nitrogen (ppm) contributed by the friction modifier (c), to the sulfur (ppm) contributed by said DMTD or DMTD derivative, or mixtures thereof (b), ranges from about 0.25:1 to about 1.25:1.

2. The lubricant composition of claim 1, wherein said DMTD or DMTD derivative, or mixture thereof provides from about 100 to about 2000 ppm by weight of sulfur to the lubricant composition based on a total weight of the lubricant composition.

3. The lubricant composition of claim 1, wherein said DMTD or DMTD derivative, or mixture thereof provides from about 500 to about 800 ppm by weight of sulfur to the lubricant composition based on a total weight of the lubricant composition.

4. The lubricant composition of claim 1, wherein the friction modifier (c) provides from about 150 to about 500 ppm by weight nitrogen to the lubricant composition based on a total weight of the lubricant composition.

5. The lubricant composition of claim 1, wherein a weight ratio of nitrogen (ppm) contributed by the friction modifier (c), to the sulfur (ppm) contributed by said DMTD or DMTD derivative, or mixtures thereof (b), ranges from about 0.3:1 to about 0.75:1.

6. The lubricant composition of claim 1, wherein the $C_{10}$-$C_{36}$ vinylidene olefin is reacted with maleic acid, anhydride, or ester under thermal ene reaction conditions.

7. The lubricant composition of claim 1, wherein the base oil comprises more than about 30 wt. % of the total weight of the lubricant composition.

8. A transmission fluid comprising the lubricant composition of claim 1.

9. The transmission fluid of claim 8, wherein the fluid has a low temperature Brookfield viscosity at −40° C. of less than 14,000 centipoise (cp).

10. The transmission fluid of claim 9, wherein the fluid has lead coupon weight loss in an aluminum beaker oxidation test (ABOT) at 100 hours of less than 0.5 wt. %.

11. The transmission fluid of claim 10, wherein the fluid has a low velocity friction apparatus (LVFA) durability at 40° C. of greater than 300 hours.

12. A transmission for a vehicle comprising a lubricant composition, wherein said lubricant composition comprises:

a). a base oil;

b). 2,5-dimercapto-1,3,4-thiadiazole (DMTD), a derivative of DMTD, or mixtures thereof; and c). a friction modifier made by:

i). reacting an olefin, wherein at least 40% by weight of the olefin is a $C_{10}$-$C_{36}$ vinylidene olefin that was reacted under acid-catalysis condition then treated with maleic acid, anhydride, or ester to provide a first reaction product; and ii). aminating the first reaction product with an effective amount of a compound containing basic nitrogen to provide the friction modifier, wherein said $C_{10}$-$C_{36}$ vinylidene olefin is represented by the following formula:

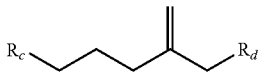

wherein $R_c$ and $R_d$ are independently a ($C_3$-$C_{15}$) alkyl, cycloalkyl or cycloalkenyl, wherein the friction modifier (c) provides from about 50 to about 800 ppm by weight of nitrogen to the lubricant composition based on a total weight of the lubricant composition and wherein a weight ratio of nitrogen (ppm) contributed by the friction modifier (c), to the sulfur (ppm) contributed by said DMTD or DMTD derivative, or mixtures thereof (b), ranges from about 0.25:1 to about 1.25:1.

13. The transmission of claim 12, wherein said DMTD or DMTD derivative, or mixture thereof provides from about 100 to about 2000 ppm by weight of sulfur to the lubricating fluid based on a total weight of the lubricant composition.

14. A method for providing a multi-vehicle transmission fluid comprising:

blending an oil of lubricating viscosity with:

i). from about 100 to about 2000 ppm by weight 2,5-dimercapto-1,3,4-thiadiazole (DMTD), a derivative of DMTD, or mixtures thereof in terms of sulfur content of the transmission fluid derived from component (i); and ii). from about 50 to about 800 ppm friction modifier in term of nitrogen content by weight of the total weight of the transmission fluid, wherein the friction modifier is made by:

a). reacting an olefin containing at least 40% by weight of a $C_{10}$-$C_{36}$ vinylidene olefin that was reacted under acid-catalysis condition then treated with maleic acid, anhydride, or ester to provide a first reaction product; and b). aminating the first reaction product with an effective amount of a compound containing basic nitrogen to provide the friction modifier, wherein said $C_{10}$-$C_{36}$ vinylidene olefin is represented by the following formula:

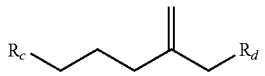

wherein $R_c$ and $R_d$ are independently a ($C_3$-$C_{15}$) alkyl, cycloalkyl or cycloalkenyl, wherein a weight ratio of nitrogen (ppm) contributed by the friction modifier (c), to the sulfur (ppm) contributed by said DMTD or DMTD derivative, or mixtures thereof (b), ranges from about 0.25:1 to about 1.25:1.

15. The method of claim 14, wherein the transmission fluid has a low temperature Brookfield viscosity at −40° C. of less than 14,000 centipoise (cp).

16. The method of claim 14, wherein the transmission fluid has lead coupon weight loss in an aluminum beaker oxidation test (ABOT) at 100 hours of less than 0.5 wt. %.

17. The method of claim 14, wherein the transmission fluid has a low velocity friction apparatus (LVFA) durability at 40° C. of greater than 300 hours.

* * * * *